United States Patent [19]

Hawkes et al.

[11] Patent Number: 4,686,927

[45] Date of Patent: Aug. 18, 1987

[54] TETHER CABLE MANAGEMENT APPARATUS AND METHOD FOR A REMOTELY-OPERATED UNDERWATER VEHICLE

[75] Inventors: Graham S. Hawkes; David C. Jeffrey, both of Oakland, Calif.

[73] Assignee: Deep Ocean Engineering Incorporated, Oakland, Calif.

[21] Appl. No.: 832,705

[22] Filed: Feb. 25, 1986

[51] Int. Cl.[4] ..... B63G 8/00; B63G 8/24

[52] U.S. Cl. ..... 114/312; 104/173.1; 104/226; 114/331

[58] Field of Search ..... 114/312, 330, 331, 253, 114/254; 441/23-26; 405/185; 104/173.1, 226, 237

[56] References Cited

U.S. PATENT DOCUMENTS

| | | | |
|---|---|---|---|
| 3,597,778 | 8/1971 | Castelliz | 441/25 |
| 4,010,619 | 3/1977 | Hightower et al. | 114/322 X |
| 4,324,195 | 4/1982 | Cunningham | 114/312 |
| 4,487,153 | 12/1984 | McMahon et al. | 114/312 |

FOREIGN PATENT DOCUMENTS

| | | | |
|---|---|---|---|
| 117541 | 12/1929 | Fed. Rep. of Germany | 104/226 |
| 498814 | 5/1930 | Fed. Rep. of Germany | 104/237 |
| 3116714 | 11/1982 | Fed. Rep. of Germany | 104/173 R |

*Primary Examiner*—Sherman D. Basinger

*Attorney, Agent, or Firm*—Manfred M. Warren; Robert B. Chickering; Glen R. Grunewald

[57] ABSTRACT

A negatively buoyant tether cable management apparatus for use with a remotely-operated underwater vehicle is disclosed. The apparatus includes a cable climbing assembly, a depth sensor and a controller coupled to the climbing assembly and formed to actuate the climbing assembly to climb the tether cable when the cable management apparatus has been lowered to a predetermined depth. The climbing assembly includes a pair of powered, ribbed belts which are wrapped at least partially around the periphery of the tether cable at an acute angle to the cable. As the tether cable is lowered further, the climbing assembly climbs to maintain the depth and passes the tether cable out below or beyond the climbing assembly to enable maneuvering of the remotely-operated underwater vehicle with respect to the negatively buoyant cable management apparatus. A method of using the weight of the cable management apparatus to maintain the tether cable taut from the surface down through the wave-action interface so that the underwater vehicle does not get swept by current or wave action into obstacles also is disclosed.

26 Claims, 5 Drawing Figures

TETHER CABLE MANAGEMENT APPARATUS AND METHOD FOR A REMOTELY-OPERATED UNDERWATER VEHICLE

BACKGROUND OF THE INVENTION

Remotely-operated underwater or sub-sea vehicles, known in the industry as "ROVs," are in widespread use in connection with a variety of different underwater applications. One area in which these underwater vehicles or submarines are frequently employed is in the off-shore oil drilling industry. An ROV typically will be lowered on a tether cable off the drilling platform so that it can be operated through command signals sent down electrical conductors in the cable to permit remote viewing of the drill stack or ocean floor. Some ROVs also include mechanical manipulators which can be used to perform various underwater tasks associated with the drilling operation.

As will be appreciated, the deployment of an ROV in heavy seas or in a strong current, which are typically present in locations such as the North Sea, for example, can pose serious problems. Usually ROVs are approximately neutrally buoyant. Accordingly, the wave action and/or current can easily sweep the tether-operated submarine underneath the platform and into the drill stack with resultant damage to the vehicle and/or wrapping of the tether cable around the drill stack.

In order to avoid this problem, such vehicles are typically deployed in heavy sea environments from a so-called "garage." An ROV garage is a negatively buoyant framework in which the neutrally buoyant underwater vehicle is housed. The garage is lowered by a lowering cable from the drilling platform, and in addition to the ROV, the garage includes a powered reel or cable storage device with a bailer that permits paying out and reeling in of the ROV tether cable from the garage. This negatively buoyant garage assembly allows the ROV to be lowered down through the wave-action interface to the desired depth while keeping the lowering cable taut, at which point the ROV swims out of the garage and ROV cable is paid out of the garage by the powered reel to permit remote operation of the underwater vehicle.

Such garage-deployed ROVs have performed satisfactorily, but the garage tends to be a relatively complex and heavy structure that adds considerably to the overall cost of the system. In effect, two winches are provided, one on the platform to lower the garage by the lowering cable and one inside the garage to pay out the ROV cable. In addition, the controls become more complex and the strength of the lower cable between the garage and the platform-mounted winch must be strong enough to carry the substantial weight of the garage and ROV.

OBJECTS AND SUMMARY OF THE INVENTION

Accordingly, it is an object of the present invention to provide a tether cable management apparatus for use with a remotely-operated underwater vehicle that can be used to deploy an ROV in heavy seas.

Another object of the present invention is to provide a negatively buoyant, tether cable management apparatus and method which is highly effective in the deployment of an ROV in heavy seas and does not require a garage or multiple winch assemblies.

Still a further object of the present invention is to provide a method of deploying a remotely-operated underwater vehicle in heavy seas which allows the vehicle to be deployed by means of a standard underwater tether or control cable.

A further object of the present invention is to provide a tether cable management system which has improved efficiency, is less expensive to construct and operate and is easier to use than prior systems for deploying ROVs.

Still another object of the present invention is to provide tether cable climbing apparatus for use in a tether management system for a remotely-operated underwater vehicle which will permit deployment of the underwater vehicle through a zone of heavy waves and/or current.

It is another object of the present invention to provide a tether cable climbing apparatus which does not damage or fatigue the tether cable and is suitable for use with a standard, unarmored control cable.

The tether management system and method of the present invention have other objects and features of advantage which will become more apparent from and are set forth in more detail in the accompanying drawings and the following description of the preferred embodiment.

The negatively buoyant tether cable management apparatus of the present invention is comprised, briefly, of a tether cable climbing assembly which is formed for mounting on a tether cable to a remotely-operated underwater vehicle proximate the vehicle. The climbing assembly has powered tether cable gripping means formed to grip and advance the apparatus up and down the tether cable, depth sensing means for detecting the depth underwater at which the climbing assembly is positioned, and control means coupled to the depth sensing means and to the climbing assembly. The control means is input with control criteria and preferably includes means for actuating and controlling the direction and extent of operation of the climbing assembly as determined by such input and the depth underwater detected by the depth sensing means. The control means most preferably is employed to maintain the climbing assembly at a predetermined depth so that further lowering of the tether cable beyond the predetermined depth causes the climbing assembly to begin to climb up the cable and pay out cable below the climbing assembly which the ROV can use to maneuver. As the cable is lowered by the winch on the platform at the surface, the tether management apparatus first acts as a negatively buoyant weight which carries the ROV down through the wave interface with the tether cable taut, and then allows the tether cable to advance beyond the tether cable climbing assembly to free the vehicle for maneuvering with respect to the climbing assembly on a slack section of cable.

The method of deploying a remotely-operated underwater vehicle of the present invention comprises the steps of coupling the vehicle to a deployment tether, mounting a negatively buoyant tether climbing apparatus to the tether proximate the vehicle, lowering the vehicle and climbing apparatus to a predetermined depth, paying out the tether cable beyond such depth to cause the climbing apparatus to climb the tether and to pass paid out tether cable beyond the climbing apparatus, and thereafter, maneuvering the vehicle with respect to the climbing apparatus on the tether cable.

The method of propelling a cable climbing assembly along a cable is comprised, briefly, of the steps of engaging a side of the cable with a movable belt of the cable climbing assembly with the belt being wrapped in a spiral path around a portion of the outer surface of the cable at an acute angle to the longitudinal axis of the cable, and advancing the belt while maintaining the cable in frictional contact therewith to produce relative movement between the cable and climbing assembly along the longitudinal axis of the cable. In the preferred form of the invention opposite sides of the cable are engaged by movable belts wrapped in opposite spiral paths, and both belts are simultaneously advanced in complimentary directions to produce movement of the cable climbing assembly along the cable.

DESCRIPTION OF THE PREFERRED EMBODIMENT

The tether cable management system of the present invention is shown for the purposes of illustration as it would be employed in an off-shore oil exploration application. It will be understood, however, that the system of the present invention can be used in numerous other applications without departing from the scope of the present invention.

Figure 1:
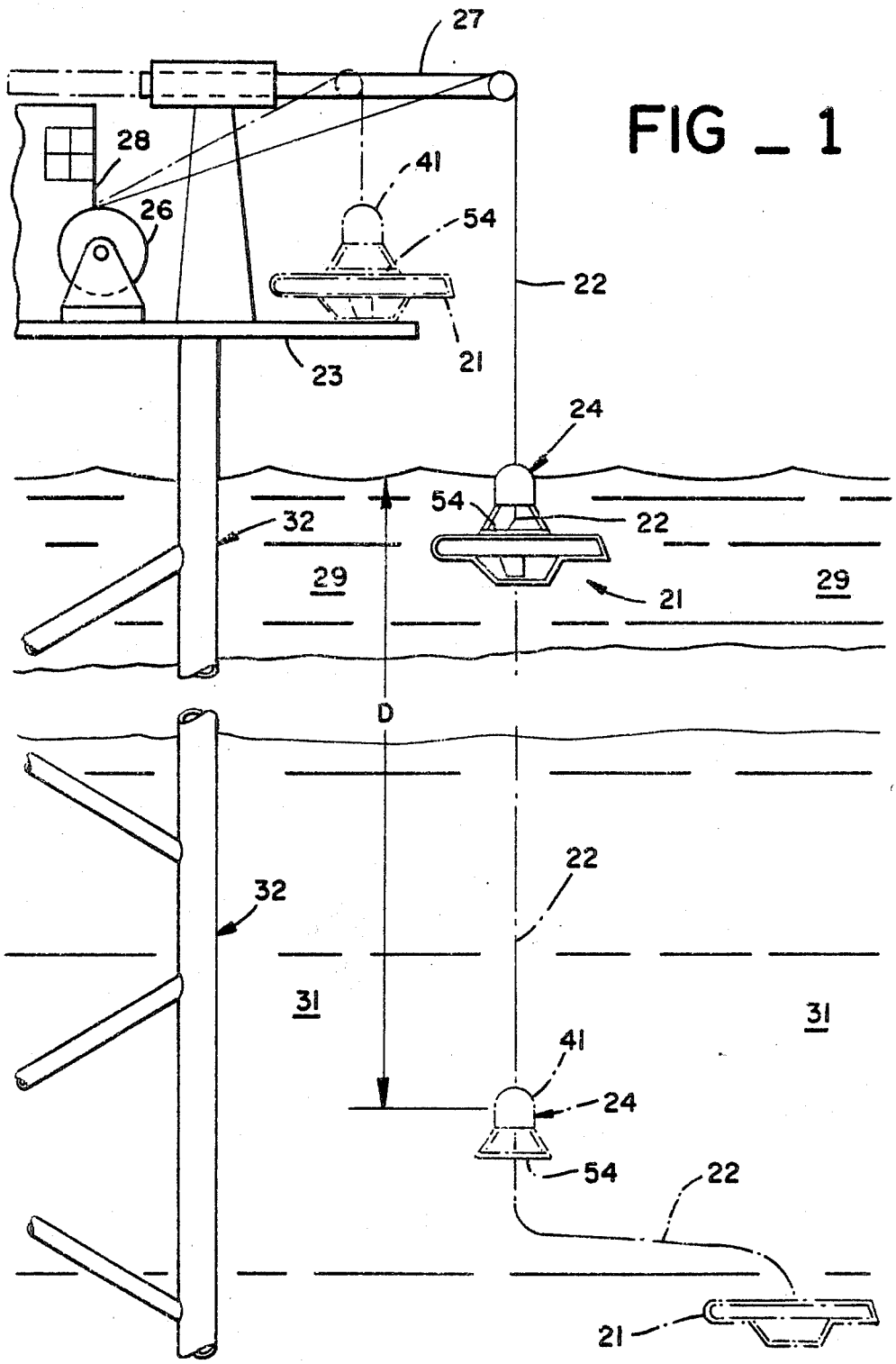
FIG. 1 is a schematic, side elevation view of an oil exploration platform showing deployment of a remotely-operated underwater vehicle using a tether cable management system constructed in accordance with the present invention.

In FIG. 1 a remotely-operated underwater vehicle, generally designated 21, is shown being lowered by a tether cable 22 from platform 23. Mounted proximate ROV 21 is a tether cable management apparatus, generally designated 24.

In order to deploy vehicle or submarine 21, a platform mounted tether storage and deployment means, such as winch 26 and movable boom 27, can be used to lower the vehicle and tether management apparatus over the edge of the platform pursuant to control signals from control booth 28 on the platform. Tether management apparatus 24 is negatively buoyant and will carry the vehicle down through the wave-action interface 29 into a relatively still water zone 31 without allowing cable 22 to become slack and the vehicle and management apparatus to be swept under the platform and into drill stack 32.

Once the ROV and deployment system 24 reach a predetermined depth, D, depth sensing means will cause tether cable management apparatus 24 to start to climb tether cable 22 as winch 26 pays out more cable. The result is that cable 22 is held taut between boom 27 and management apparatus 24 and yet passes down beyond apparatus 24 and is slack therebeyond to permit ROV 21 to swim away from the tether cable management apparatus. The operator in the control booth 28 can continue to pay out tether cable 22 in order to provide ROV 21 sufficient tether cable length to maneuver and perform any desired tasks.

To retrieve remotely-operated underwater vehicle 21, the operator reels in cable 22 by winch 26 to cause the ROV to move toward tether management apparatus 24. As the cable is reeled in, tether management apparatus 24 climbs down the cable to try and maintain its depth at D. When ROV 21 reaches cable management apparatus 24, further reeling in of cable 22 will bring the combination of the management apparatus 24 and ROV 21 up to the water surface and platform 23. The sequence showing the system in phantom on platform 23, solid lines in zone 29 and phantom in zone 31, therefore, illustrates operation of the combination during either deployment or retrieval.

Figure 2:
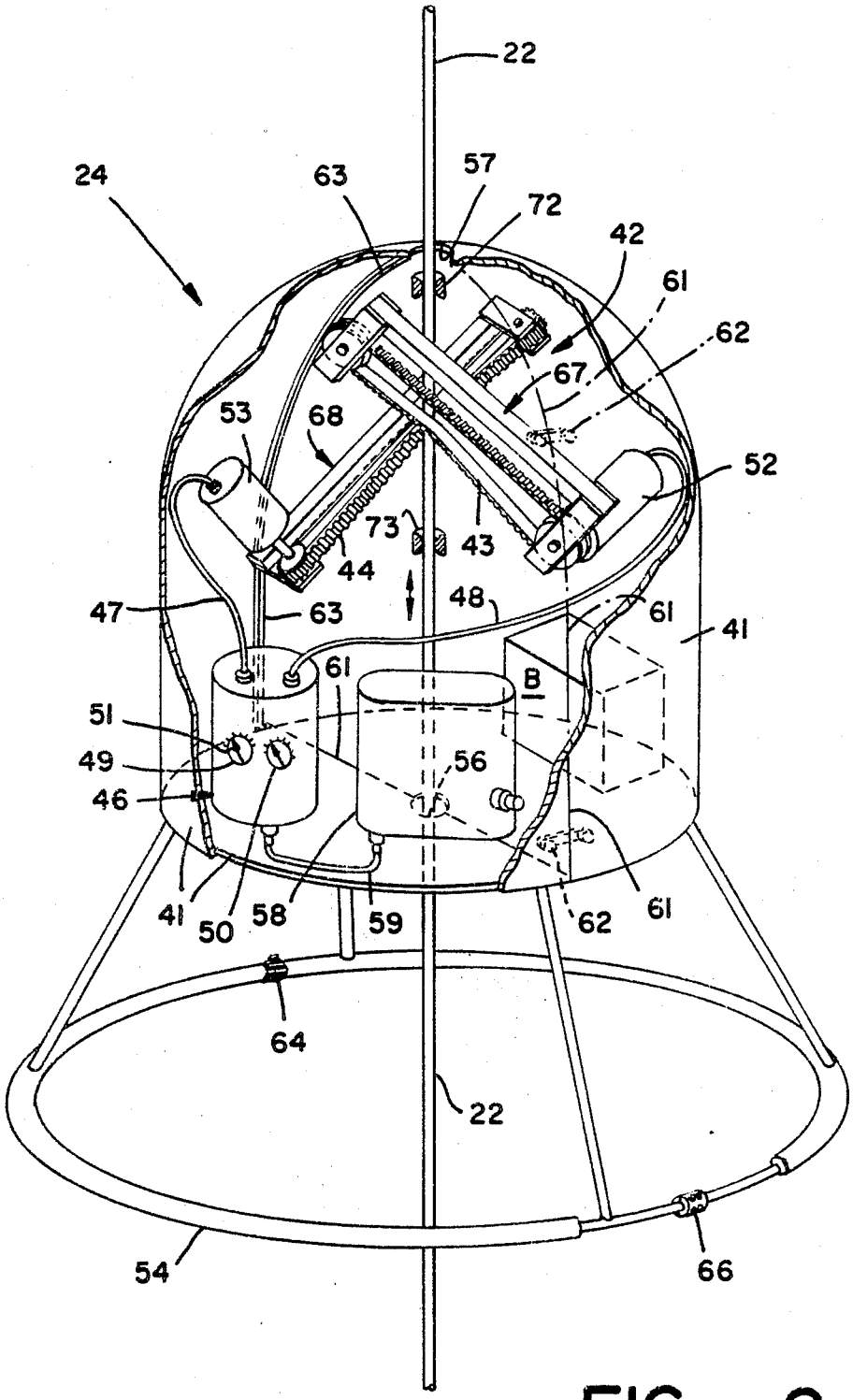
FIG. 2 is an enlarged, top perspective schematic representation, partially broken away, of a tether cable management apparatus constructed in accordance with the present invention.

Referring now to FIG. 2, the details of construction of tether cable management apparatus 24 can be set forth. Mounted within housing 41 is a tether cable climbing assembly. Preferably the climbing assembly is formed for removable mounting on tether cable 22 proximate the remotely-operated underwater vehicle. Climbing assembly 42 includes powered tether cable gripping means 42 here shown as a pair of cable engaging, flexible, endless drive belts 43 and 44. Belts 43 and 44 grip the sides of cable 22 and advance the entire tether management apparatus up and down the length of cable 22 in accordance with control means, generally designed 46, coupled at 47 and 48 to gripping means 42. Control means 46 includes depth sensing means 49 for detecting the depth underwater at which the climbing assembly is positioned. Input to control means 46 can be comprised of manual setting of depth control knob 51 to set the same at a predetermined depth for operation. Alternatively, control means 46 can be input electronically and even remotely if desired.

Control means 46 is coupled to actuate and control the direction and extent of operation of climbing assembly 26 by controlling the operation of motors 52 and 53 which power belts 43 and 44, respectively. Control apparatus for the operation of motors in response to signals from a depth sensor is well known in the art and will not be set forth in detail herein.

In the preferred form, control means 46 is formed to maintain the climbing apparatus and the tether cable management system 24 substantially within a range of predetermined depths underwater, and most preferably at about the depth input by knob 51. Thus, control means 46 will cause motors 52 and 53 to operate in a direction maintaining the cable management apparatus at the depth set by knob 51. When the depth sensing means 49 senses that apparatus 24 is above the depth D, motors 52 and 53 will be turned on in a direction which will drive the belts so as to carry the negatively buoyant assembly down the tether cable 22 until depth D is reached, at which point control means 46 will shut down both the motors. If the cable is paid out further, the depth sensor 49 will sense the change in depth and cause the motors to be turned on so that the climbing assembly tends to climb up the tether cable 22 so as to maintain the predetermined depth. As will be understood, control means 46 and input 51 can provide for actuation of climbing assembly motors 52 and 53 only if the assembly should be displaced upwardly or downwardly out of a range of depths. Moreover, it is preferable that control means 46 have suitable electronic delays therein so that surge and wave action on the surface will not cause the motors to be constantly operated in an attempt to compensate for such wave action.

In a preferred form, control means 46 also includes activation circuit means 50 for activating and deactivating motor controller 46. Thus, depth sensor 49 can be used to sense two depths, namely, an activation depth and a target depth. If controller 46 remains "on" during the full duration of raising and lowering of the tether management apparatus and the remotely operated underwater vehicle, the motors would be "on" and urging the docking collar or ring 54 against the remotely operated vehicle. If the target depth for the cable management apparatus 24 is 300 feet, the actuation depth might be 250 feet. As management apparatus 24 and vehicle 21 are being lowered, the climbing assembly 42 will not be turned "on" by the activation circuit 50 until the tether management apparatus reaches 250 feet. Apparatus 24 will then want to move down the cable because it has not reached the target depth of 300 feet. This will cause the motors 52 and 53 to be turned "on" to try to drive the management apparatus down the cable, but collar 54 will engage the ROV. Accordingly, it will not be possible for the tether management apparatus to go down the cable. Once the winch has lowered cable 22 to 300 feet, controller 46 will switch the motors to "off." If the cable is lowered beyond 300 feet, the motors will come on and tend to be driven in a direction causing apparatus 24 to climb cable 22 and pass cable beyond the apparatus through openings 56 and 57 in housing 41. This permits vehicle 21 to swim away from the tether management assembly 24, which will maintain its depth at about the target depth of 300 feet.

When the system is reeled in by winch 26, control means 46 will drive belts 43 and 44 in a direction causing the cable climbing assembly to go down the cable as the cable is being raised by winch 26. Finally, collar 54 will engage the remotely-operated submarine so that the ROV and cable management apparatus are brought up as a unit. Control means 46 will continue to actuate motors 52 and 53 to attempt to drive the assembly down the cable until management apparatus 24 and vehicle 21 reach the actuation depth of 250 feet, at which point activation circuit 50 will shut down control means 46 and motors 52 and 53. The entire assembly can then be raised by winch 26 with the negatively buoyant tether management apparatus 24 keeping the cable taut until the assembly is lifted onto deployment platform 23.

Since the remotely-operated underwater vehicle will conventionally carry depth sensing means which will transmit depth signals to the platform through tether cable 22, it is also possible that control means 46 be provided in booth 28 and the control of motors 52 and 53 be accomplished by remotely located control means coupled, for example, by sonar transmission to switch motors 52 and 53 "on" and "off." In the preferred form, however, control means 46 and depth sensor 49 are both carried by climbing assembly 42 or more particularly housing 41 to which the climbing assembly is mounted.

The function of housing 41 is primarily to generally shield climbing assembly 42 and control means 46 from impact with debris or underwater structures. Additionally, housing 41 can be used to support ballast B, as may be required to produce the most desirable negative buoyancy for the tether management apparatus and water conditions. Also mounted within the housing is a battery 58 which may be electrically connected by conductor 59 to controller 46 in order to power electrical motors 52 and 53 and the controller.

In order to permit mounting and removal of the tether management system to cable 22 housing 41 is preferably formed with movable gate means which allows the housing to be moved to an open position permitting mounting of the housing and climbing assembly onto and demounting of the same from tether cable 22. As shown in FIG. 2, the housing is split along line 61 and provided with latch means 62 and hinge means 63. Additionally, the collar 54 can be hinged at 64 and releasably joined together by a coupling or latch at 66 so that once the latches 62 and 66 are opened, the two halves of the housing can be swung to the open position.

Figure 3:
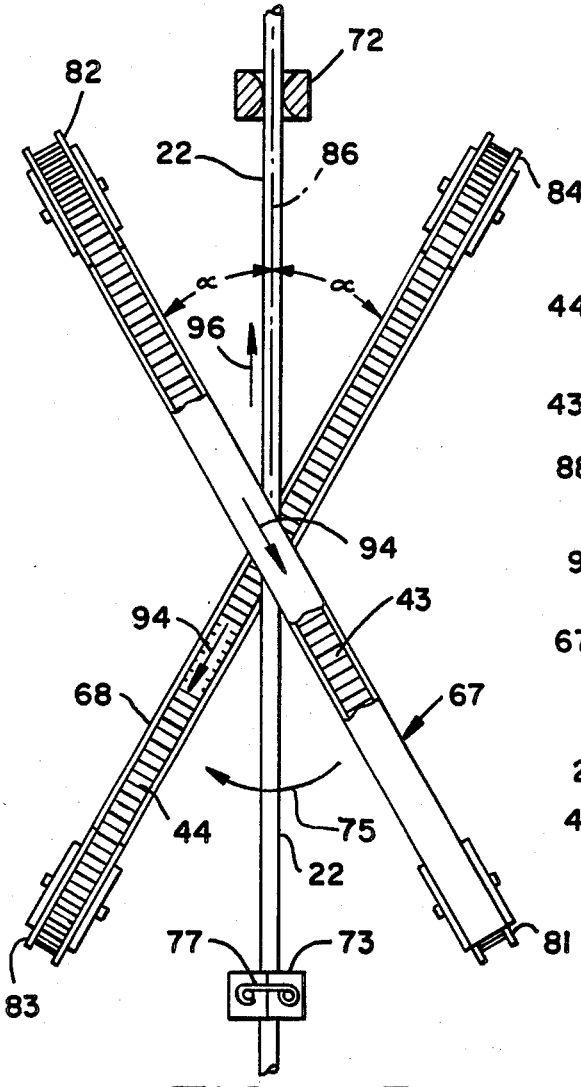
FIG. 3 is a further enlarged, front elevation view of the belt-based cable climbing assembly of the apparatus of FIG. 2.

In the illustrated construction, it is preferable that motor 52 and associated framework 67 be mounted to one-half of housing 41, while motor 53 and associated framework 68 be mounted to the other half of housing 61 by brackets (not shown). As the housing halves are swung to the open position, therefore, at least one of belts 43 and 44 will move away from and out of engagement with tether cable 22. Additionally, it is preferable to have tether cable guide means 72 and 73 which are mounted to housing 41 by brackets or mounting arms (not shown) which must also be unlatched or opened to permit removal of tether cable 22 from guides 72 and 73. Thus, guides 72 and 73 may be hinged to the back side and provided with a latch 77 (FIG. 3). As will be understood, openings 56 and 57 could also act as lateral guides for cable 22.

As will be understood, openings 56 and 57 will permit entry of water into housing 41. Thus, the entire housing is normally filled with water once tether management apparatus 24 is submerged. Housing 41 can, therefore, merely be a protective framework instead of an enclosed housing or shell, but it is preferable to form housing 41 as a shell so as to shield the driving belts 43 and 44 from debris. As used herein, however, "housing" shall be understood to include an open framework.

The tether cable climbing assembly can be described in more detail by reference to FIGS. 3, 4 and 5. Belt assembly 42 includes mounting means such as brackets 67 and 68, to which pairs of sheaves 81–84 are rotatably mounted. Endless flexible belts 43 and 44 are carried on sheaves 81–84, and the mounting frames 67 and 68 orient the belts so that they engage tether cable 22 at an acute angle $\alpha$, to the longitudinal axis 86 of tether cable 22 (FIG. 3). Although it is possible to construct a climbing assembly with a single belt and guide means 72 and 73, it is most advantageous to employ at least a pair of belts, with one belt engaged and at least partially wrapped around, a first side of cable 22 and a second belt engaged and wrapped around an opposite side of the tether cable. Moreover, it is preferable that the angle $\alpha$ at which each of belts 43 and 44 engage cable 22 be substantially identical on opposite sides of axis 86, which tends to balance the dynamic forces and reduce the stress on the cable. The angle $\alpha$ is preferably is less than about 30 degrees in order to provide a substantial driving component along axis 86 and is desirably as reasonably close to zero degrees as can be mechanically achieved while still crossing the cable.

Figure 4:
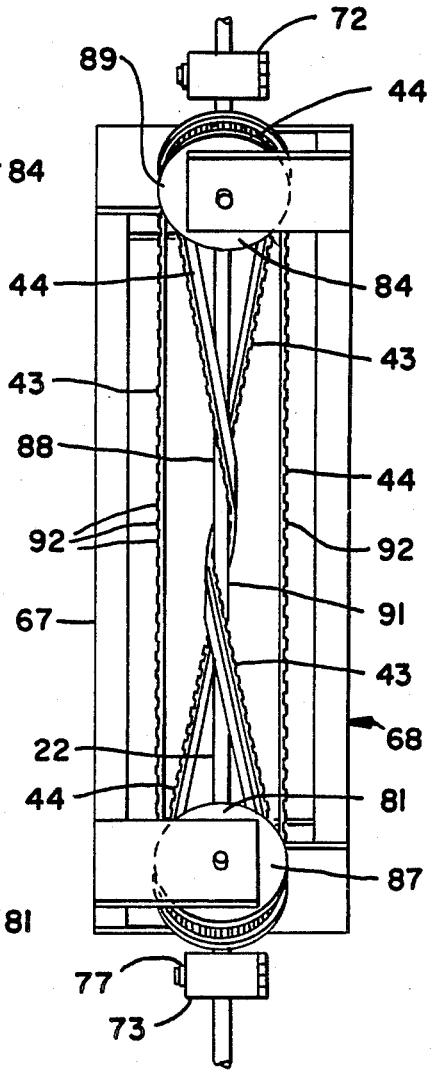
FIG. 4 is a side elevation view of the tether cable climbing assembly of FIG. 3.
Figure 5:
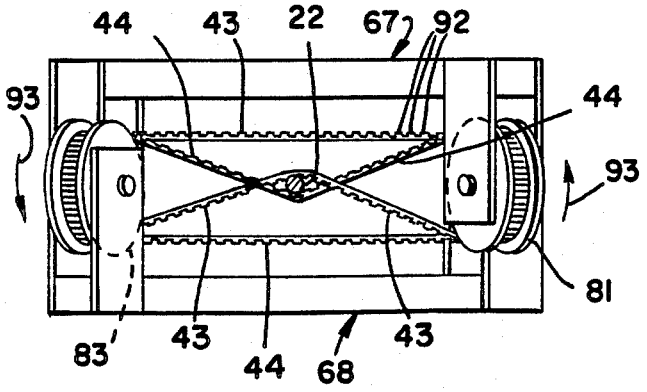
FIG. 5 is an end elevation view of the tether cable climbing assembly of FIG. 3.

As best may be seen in FIGS. 4 and 5, frame 67 mounts sheave 81 so that the axis of rotation is about in the same plane as cable 22 and belt 43 extends from a side 87 of the tether sheave 81 on one side of cable 22 (namely, side 91) to the opposite side cable 22 (namely, side 88) and back to a side of sheave 82 on side 91 of the cable. This causes flexible belt 43 to be wrapped around a portion of the circumference of side 88 of the tether cable so as to provide good frictional engagement therebetween. In a similar fashion, the sheaves 83 and 84 are held by frame members 68 so that belt 44 leaves the side 89 of sheave 84, which is positioned on side 88 of the cable and passes over to the opposite side 91 of the cable before returning to sheave 83 and side 88 of the cable. This wraps which is engaged by belt 44 around side 91 of the cable.

To further enhance the frictional engagement of the flexible belts with tether cable 22, it is desirable that the belts be formed as transversely ribbed gear belts with the ribs 92 mounted to engage tether 22. Essentially, gear belts 43 and 44 are mounted on pulleys 81–84 upside down so that the ribs 92 engage the tether, not the sheaves, as would be conventional.

It should be noted that further frictional engagement and driving of the tether management apparatus 24 along tether cable 22 can be achieved by employing cable gripping means 42 which is comprised of more than two endless belts wrapped around the tether cable. Thus, three belts could be employed at about 120 degree intervals around the cable circumference. Similarly, additional sets of belts can be stacked along the length of the cable.

As will be understood, motors 52 and 53 are coupled to drive the pairs of sheaves in a complimentary direction so that both of belts 43 and 44 drive the side of the belt engaging the tether cable in the same direction. As can be seen in FIG. 5, the arrows 93 indicate that the drive wheels rotate in what appear to be opposed directions, but the belts engaging opposite sides of the cable are moving in the same direction, as shown in FIG. 3 by arrows 94. This drives the assembly in an upward direction along tether 22, as indicated by arrow 96 in FIG. 3.

Since drive belts 43 and 44 cross over tether cable 22 at angle $\alpha$, the two belts also will produce a rotational torque force, indicated by arrow 75 in FIG. 3. Thus, the downward travel of belts 43 and 44 is accompanied by rotation of tether management apparatus 24 to the left in FIG. 3. Such rotation, of course, is reversed when belts 43 and 44 are driven in the opposite direction.

Rotation of the tether management apparatus during climbing up and down tether cable 22 does not in any way diminish the function of the apparatus to hold the cable taut. It is desirable, however, that housing 41 and collar 54 be formed as surfaces of revolution so as to minimize rotational drag and cavitation underwater.

Having described the construction of the cable tether management apparatus of the present invention, the method of deploying a remotely-operated underwater vehicle using such apparatus can be described. The method includes a coupling vehicle 21 to a standard deployment tether cable having the necessary electrical conductors therein to transmit control signals to ROV 21. The negatively buoyant and movable tether cable climbing apparatus 24 can be mounted to cable 22 proximate the vehicle with the docking collar 54 abutting the vehicle and cable gripping means 42 in frictional engagement with the cable. Next, vehicle 21 and climbing apparatus 24 are lowered into a body of water to a predetermined depth, D, and tether cable deployment and storage means 26 pays out further cable beyond depth D to cause climbing apparatus 24 to begin to climb the cable and maintain its position at depth D. Additionally, the tether is passed out beyond climbing apparatus 24, which permits maneuvering of ROV 21 with respect to the climbing apparatus on the slack tether cable passing beyond the climbing apparatus.

During retrieval, tether 22 is retrieved to cause the climbing apparatus 24 to climb down the tether until the vehicle and climbing apparatus are positioned proximate to each other, at which point the tether can be brought up with the apparatus and vehicle raised from the body of water as a unit. The tether cable is maintained in a taut condition throughout the wave-action interface by the negatively buoyant tether management apparatus.

What is claimed:

1. A negatively buoyant tether cable management apparatus for use with a remotely-operated underwater vehicle deployed on a tether cable comprising:

a tether cable climbing assembly formed for mounting on said tether cable proximate said vehicle and having powered tether cable gripping means formed to grip and advance said cable management apparatus up and down said tether cable;

depth sensing means detecting the depth underwater at which climbing assembly is positioned; and control means coupled to said climbing assembly and to said depth sensing means and formed to actuate and control the direction and extent of operation of said climbing assembly for climbing of said tether cable.

2. The tether cable management apparatus as defined in claim 1 wherein, said control means is formed to maintain said climbing assembly substantially within a range of predetermined depths underwater.

3. The tether cable management apparatus as defined in claim 1 wherein, said control means is formed to maintain said climbing assembly substantially at a predetermined depth underwater.

4. The tether cable management apparatus as defined in claim 1 wherein, said control means is carried by said climbing assembly, said control means being formed to control the amount and direction of operation of said climbing assembly in response to the depth underwater sensed by said depth sensing means.

5. The tether cable management apparatus as defined in claim 1 wherein, said cable management apparatus includes housing means, said cable gripping means, said control means and said depth sensing means being mounted in said housing means, said housing means being formed for guided receipt of said tether cable through a portion thereof and being formed for the support of ballast therefrom.

6. The tether cable management apparatus as defined in claim 5 wherein, said housing means includes movable gate means formed for selective movement between an open position permitting mounting of said housing means and gripping means to said tether cable and demounting thereof from said tether cable, and a closed position, at which said cable gripping means frictionally grips said tether cable.

7. The tether cable management apparatus as defined in claim 1 wherein, said cable management apparatus includes housing means having a docking collar formed to permit mounting to said tether cable with said docking collar abutting said vehicle for deployment of said cable management apparatus and said vehicle as a unit, said housing means and docking collar being provided as surfaces of revolution about said tether cable.

8. The tether cable management apparatus as defined in claim 1 wherein, said climbing assembly includes motor means coupled for powered driving of said gripping means and a power source carried by said climbing assembly and coupled to said motor means.

9. The tether cable management apparatus as defined in claim 1 wherein, said gripping means is provided by cable engaging flexible drive belt means movably mounted and powered to impart a driving force to said climbing assembly along the length of said cable.

10. The tether cable management apparatus as defined in claim 9 wherein, said belt means is provided by a pair of endless drive belts positioned on sheave means for engagement of opposite sides of said tether cable.

11. The tether cable management apparatus as defined in claim 10 wherein, said belts are oriented to extend at acute angles on opposite sides of the longitudinal axis of said tether cable.

12. The tether cable management apparatus as defined in claim 11 wherein, said climbing assembly includes electrical motors coupled to drive said sheave means and a battery carried by said climbing assembly.

13. The tether cable management apparatus as defined in claim 1 wherein, said control means operatively coupled between said depth sensing means and said climbing assembly; and said control means is formed to activate and deactivate operation of said climbing assembly during deployment and retrieval of said climbing assembly.

14. A tether-deployed, remotely-operated, underwater vehicle and deployment system comprising:

tether storage and deployment means formed for storage and selective paying out and retrieving of an underwater tether cable;

an underwater tether cable formed for the transmission of electrical control signals therealong and mounted to said storage and deployment means;

a remotely-operated underwater vehicle coupled to said tether cable for raising and lowering of said vehicle in a body of water by said tether cable and for transmission of control signals to said vehicle through said tether cable; and a negatively buoyant tether cable management apparatus movably mounted to said tether cable between said storage and deployment means and said vehicle, said management apparatus including depth sensing means formed to sense the depth underwater at which said cable management apparatus is deployed, and drive means coupled to said sensing means and formed to propel said cable managing apparatus up an down said tether cable in response to signals from said sensing means said drive means being further formed to maintain said cable management apparatus at about a predetermined depth underwater whereby said tether cable may be paid out to deploy said vehicle and said cable management apparatus as a unit underwater until a predetermined depth is reached, and said tether cable may be paid out beyond said depth to permit said vehicle to maneuver relative to said cable management apparatus.

15. A method of deploying a remotely-operated underwater vehicle in a body of water comprising the steps of:

coupling said vehicle to a deployment tether;

mounting a negatively buoyant tether climbing apparatus for movement along said tether proximate said vehicle, said climbing apparatus being formed to sense the depth underwater at which said climbing apparatus is submerged and to climb up and down said tether to maintain said climbing apparatus at about a predetermined depth;

lowering said vehicle with said climbing apparatus in close proximity thereto into a body of water to said predetermined depth;

paying out said tether beyond said depth to cause said climbing apparatus to climb said tether and to pass paid out tether beyond said climbing apparatus; and thereafter, maneuvering said vehicle with respect to said climbing apparatus on said tether paid out beyond said climbing apparatus.

16. The method of claim 15, and the steps of:

after said maneuvering step, retrieving said tether to cause said climbing apparatus to climb down said tether until said vehicle and said climbing apparatus are positioned proximate each other, and retrieving said tether from said body of water with said climbing apparatus and said vehicle raised from said body of water while positioned together as a unit.

17. A tether cable climbing assembly for use in a tether management system for a remotely-operated underwater vehicle comprising:

belt supporting means;

flexible belt means mounted for movement on said belt supporting means;

drive means coupled to drive said belt means on said belt supporting means; and mounting means formed to mount said belt means with a side thereof in frictional engagement with a tether cable, said mounting means orienting said belt means with the axis of advancement of said belt means skewed at an acute angle with respect to the longitudinal axis of said tether cable, and said mounting means holding said belt means at least partially wrapped around the outer surface of said tether cable to frictionally engage said tether cable with sufficient force to propel said climbing assembly along said tether cable upon driving of said belt means with said drive means.

18. A tether cable climbing assembly as defined in claim 17 wherein, said belt supporting means is provided as a pair of spaced-apart sheaves rotatably mounted to frame means;

said belt means is provided by at least one endless belt mounted on and between said sheaves;

said drive means is coupled to drive at least one of said sheaves; and said mounting means is formed to mount said side of said belt in engagement with said tether cable at an acute angle less than about 30 degrees.

19. A tether cable climbing assembly as defined in claim 18 wherein, said mounting means is formed to secure said sheaves for advancement of said belt from a position on one side of said tether cable over to an opposite side of said tether cable and back to a sheave at a position on said one side to hold said belt wrapped around the outer surface of said opposite side of said tether cable.

20. A tether cable climbing assembly as defined in claim 17 wherein, said belt supporting means is provided by two pairs of spaced-apart sheaves rotatably mounted to frame means;

said belt means is provided by at least two endless belts with a first endless belt movably mounted on a first pair of sheaves and a second endless belt mounted on a second pair of sheaves;

said drive means is coupled to drive one sheave in each of said two pairs of sheaves;

said mounting means is formed to mount said first belt wrapped around a first portion of the outer surface of said tether cable at an acute angle to a first side of said longitudinal axis, and said mounting means is formed to mount said second belt wrapped around a second portion of the outer surface of said tether cable substantially opposite said first portion and at an acute angle to a second side of said longitudinal axis opposite said first side of said longitudinal axis.

21. A tether cable climbing assembly as defined in claim 20 wherein, said mounting means includes gate means formed for selective movement of at least one of said pairs of sheaves between a position at which the belt mounted thereon engages said tether cable and a position permitting removal of said climbing assembly from said tether cable.

22. A tether cable climbing assembly as defined in claim 21 wherein, said drive means includes a pair of electric drive motors and battery means coupled to said drive motors;

said mounting means includes tether cable guide means formed to guide said climbing assembly along said tether cable and to restrain relative lateral displacement between said climbing apparatus and said tether cable.

23. A tether cable climbing assembly as defined in claim 20 wherein, said endless belts are provided as ribbed gear belts, and said gear belts are mounted to said sheaves with the ribbed sides thereof mounted in engagement with said tether cable.

24. A tether cable climbing assembly as defined in claim 20 wherein, said first pair and said second pair of sheaves each are mounted to said mounting means with the axes of rotation positioned in about the same plane as a plane passing through said longitudinal axis of said tether cable, said first belt extending between said first pair of sheaves from one side of said tether cable and passing over an opposite side of said tether cable intermediate said first pair of sheaves, and said second belt extending between said second pair of sheaves from said opposite side of said tether cable and passing over said one side of said tether cable intermediate said second pair of sheaves.

25. A method of propelling a movable one of a cable climbing assembly and a cable comprising the steps of:

engaging a side of said cable with a movable belt of said cable climbing assembly with said belt wrapped in a spiral path around a portion of the outer surface of said side at an acute angle to the longitudinal axis of said cable; and advancing said belt while maintaining said cable in frictional contact therewith to produce relative movement between said cable and said climbing assembly along said longitudinal axis.

26. The method as defined in claim 25 and the step of:

engaging an opposite side of said cable with an additional movable belt wrapped in a spiral path opposite the first-named spiral path; and simultaneous with said advancing step, advancing said additional movable belt in a direction complimenting the direction of advancing of the first-named belt.

* * * * *